US006099263A

United States Patent [19]

Bodzak et al.

[11] Patent Number: 6,099,263

[45] Date of Patent: Aug. 8, 2000

[54] FUEL DELIVERY PUMP WITH A BYPASS VALVE AND AN INLET CHECK VALVE FOR A FUEL INJECTION PUMP FOR INTERNAL COMBUSTION ENGINES

[75] Inventors: Stanislaw Bodzak, Elsbethen; Hanspeter Mayer, Hallein, both of Austria

[73] Assignee: Robert Bosch GmbH, Stuttgart, Germany

[21] Appl. No.: 09/029,378

[22] PCT Filed: Feb. 13, 1997

[86] PCT No.: PCT/DE97/00273

§ 371 Date: Jul. 27, 1998

§ 102(e) Date: Jul. 27, 1998

[87] PCT Pub. No.: WO97/49910

PCT Pub. Date: Dec. 31, 1997

[30] Foreign Application Priority Data

Jun. 26, 1996 [DE] Germany ..... 196 25 565

[51] Int. Cl.[7] ..... F02N 41/12; F04B 49/00

[52] U.S. Cl. ..... 417/295; 417/310; 417/440

[58] Field of Search ..... 417/295, 296, 417/310, 440, 441

[56] References Cited

U.S. PATENT DOCUMENTS

| | | | |
|---|---|---|---|
| 2,310,078 | 2/1943 | Herman | 417/295 |
| 2,397,480 | 4/1946 | Fullerton, Jr. | 417/295 |
| 2,481,646 | 9/1949 | Conklin | 103/120 |
| 3,146,720 | 9/1964 | Henry | 417/295 |
| 3,935,917 | 2/1976 | Eley et al. | 180/53 R |
| 4,013,053 | 3/1977 | Dinkelkamp et al. | 417/200 |
| 4,200,207 | 4/1980 | Akers et al. | 222/190 |
| 4,443,161 | 4/1984 | Masuda et al. | 417/310 |
| 4,569,202 | 2/1986 | Mouton | 60/734 |
| 4,902,202 | 2/1990 | Bowden | 417/310 |
| 4,968,218 | 11/1990 | Koivula et al. | 416/19 |
| 5,018,947 | 5/1991 | Tsuboi | 417/295 |
| 5,338,161 | 8/1994 | Eley | 417/307 |
| 5,381,723 | 1/1995 | Nilsson et al. | 9/437 |
| 5,397,219 | 3/1995 | Cretors | 417/299 |
| 5,411,375 | 5/1995 | Bauer | 417/295 |
| 5,597,291 | 1/1997 | Bodzak et al. | 417/310 |
| 5,722,738 | 3/1998 | Beck et al. | 303/116.4 |
| 5,823,639 | 10/1998 | Zinnkann et al. | 303/116.4 |

*Primary Examiner*—Charles G. Freay
*Assistant Examiner*—Robert Z. Evora
*Attorney, Agent, or Firm*—Ronald E. Greigg; Edwin E. Greigg

[57] ABSTRACT

The invention relates to a fuel delivery pump for a fuel injection pump for internal combustion engines, with a pair of rotating displacing elements, which deliver fuel from an intake chamber connected to a storage tank, along a supply conduit that is formed between the end face of the rotating displacing elements and the circumference wall of the pump chamber, into a pressure chamber connected to the fuel injection pump, and with a bypass conduit, which is integrated into a housing of the fuel delivery pump and connects the intake chamber to the pressure chamber, and which is opened by means of a pressure valve disposed in it, wherein the intake chamber is closed with a check valve that operates counter to the fuel delivery direction.

17 Claims, 3 Drawing Sheets

FUEL DELIVERY PUMP WITH A BYPASS VALVE AND AN INLET CHECK VALVE FOR A FUEL INJECTION PUMP FOR INTERNAL COMBUSTION ENGINES

PRIOR ART

The invention is based on a fuel delivery pump for a fuel injection pump for internal combustion engines.

EP 0 166 995 B1 has disclosed a fuel delivery pump of this kind embodied as a gear delivery pump, which feeds the fuel from a storage tank into the intake chamber of a fuel injection pump. To that end, the delivery pump has a pair of gears that mesh with external engagement, which delivers fuel from an intake chamber connected to the storage tank via an intake line, into a pressure chamber connected to the intake chamber of the fuel injection pump via a supply line. To control the pressure in the pressure chamber or the feed quantity to the fuel injection pump, a bypass conduit is provided between the pressure chamber and the intake chamber of the fuel delivery pump. The opening of this bypass conduit is carried out by means of a pressure valve inserted in the bypass conduit, which valve unblocks a particular opening cross section as a function of the spring force of the valve spring when there is a particular pressure difference between the pressure chamber and the intake chamber. The opening time of the pressure valve can be set via the initial force of the valve spring, which is why the axial position of the abutment of the pressure valve spring can be adjusted.

The known fuel delivery pump, however, has the disadvantage that the bypass conduit that contains the pressure valve is disposed outside the delivery pump or spatially speaking, relatively far from the gear pair, which results in an increase in construction and assembly costs as well as taking up a lot of space.

The German Patent Application P 44 41 505.2 has disclosed a fuel delivery pump which avoids the above mentioned disadvantages. The bypass conduit that contains the pressure valve is integrated into the housing of the delivery pump so that no additional space is required.

Both fuel delivery pumps, however, have the disadvantage that when the fuel delivery pump is shut off, the fuel present in the pump chamber can flow into the intake line leading to the fuel delivery pump and the fuel delivery pump can empty. As a result, sometimes the intake line has to be ventilated when restarting.

ADVANTAGES OF THE INVENTION

The fuel delivery pump according to the invention for a fuel injection pump for internal combustion engines has the advantage over the prior art that a check valve that can close the intake chamber of-the fuel delivery pump prevents the fuel delivery pump from emptying when the motor is shut off. As a result, immediately after restarting, fuel can be delivered to the fuel delivery pump of the fuel injection pump so that the required delivery pressure for the fuel can be built up within a short time. Consequently, the disposition of a check valve which closes the intake chamber can achieve a higher efficiency when starting. It is furthermore advantageous that the fuel delivery pump remains wet with fuel when the motor is shut off so that no corrosion can occur. It is particularly advantageous to dispose the check valve in an opening that leads to the intake chamber so that a fuel delivery pump can be embodied with a small amount of space.

The check valve that closes the intake chamber furthermore has the advantage of functioning as a flow resistor with a throttling action during operation of the fuel delivery pump. Through the throttling of the fuel in the intake line, the delivery flow can be reduced with increasing speed. As a result, a gentle transition can be achieved from the steadily increasing delivery flow to the maximal delivery flow, by means of which a low amount of operating power is required to deliver the fuel. The excess quantity is usually diverted via a pressure limiting valve. This makes it possible for the characteristic curve of the pump to have the ability to be adapted to a required characteristic curve, by means of which due to the smaller throttled quantity, a less intense heating of the fuel delivery pump can be achieved. At the same time, the check valve functions as a suction throttle when the speed and delivery quantity are increasing. This means that the suction throttle only lets through a particular quantity when there is a given pressure difference upstream and downstream of the throttle. Since the suction throttle is inserted into the intake line, the maximal pressure difference can only be approx. 1 bar. This corresponds to a difference between the surrounding air pressure and vacuum. When the vacuum increases, however, the pressure falls below the vapor pressure and the evaporation pressure. The fuel consequently foams up downstream of the throttle, the volume increases, and the foamed fuel arrives in the pump chamber and is transmitted into the fluid phase again during the compression phase. The attendant volume reduction is compensated for by fuel returning from the pressure chamber. This means that starting at a particular "critical" speed, the pump effectively delivers less volume per unit time. As a result, with a definite requirement, fewer excess quantities of fuel are diverted via the pressure limiting valve.

According to the invention, a multi-fuel pump, for example for lubrication oil, can also be embodied in accordance with the features set forth herein.

Other advantages and advantageous embodiments of the subject of the invention can be inferred from the description the drawings, and the claims.

BRIEF DESCRIPTION OF THE DRAWINGS

The drawings show two exemplary embodiments of the fuel delivery pump according to the invention, which are explained in detail in the description below.

DESCRIPTION OF THE EXEMPLARY EMBODIMENTS

Figure 1:
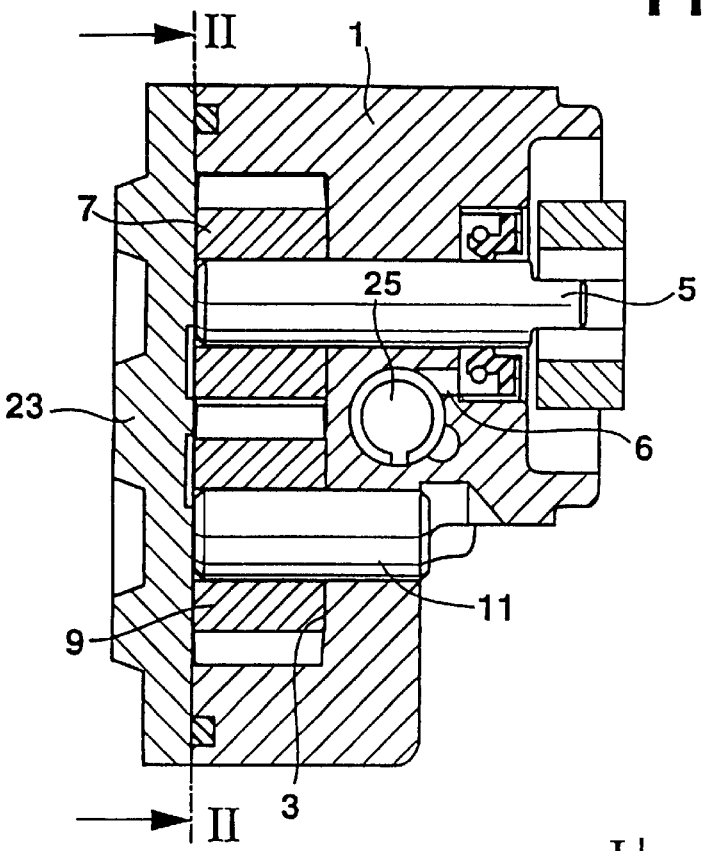
FIG. 1 is a longitudinal section through the fuel delivery pump along line I—I of FIG. 2.
Figure 2:
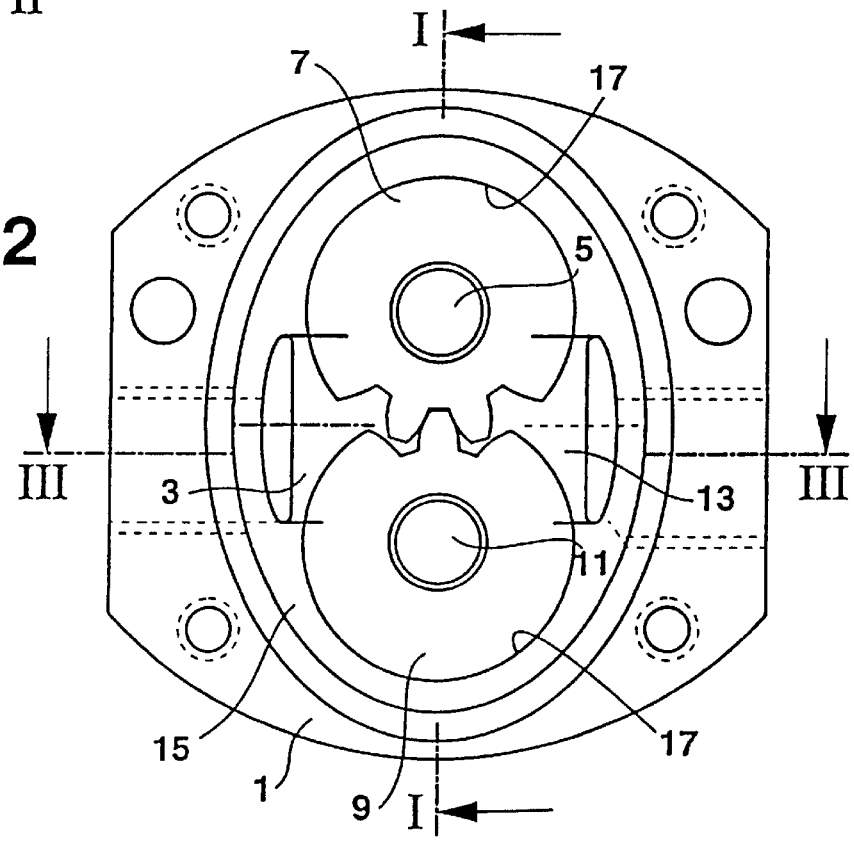
FIG. 2 is a top view of the fuel delivery pump shown in FIG. 1, with the cover taken off.
Figure 3:
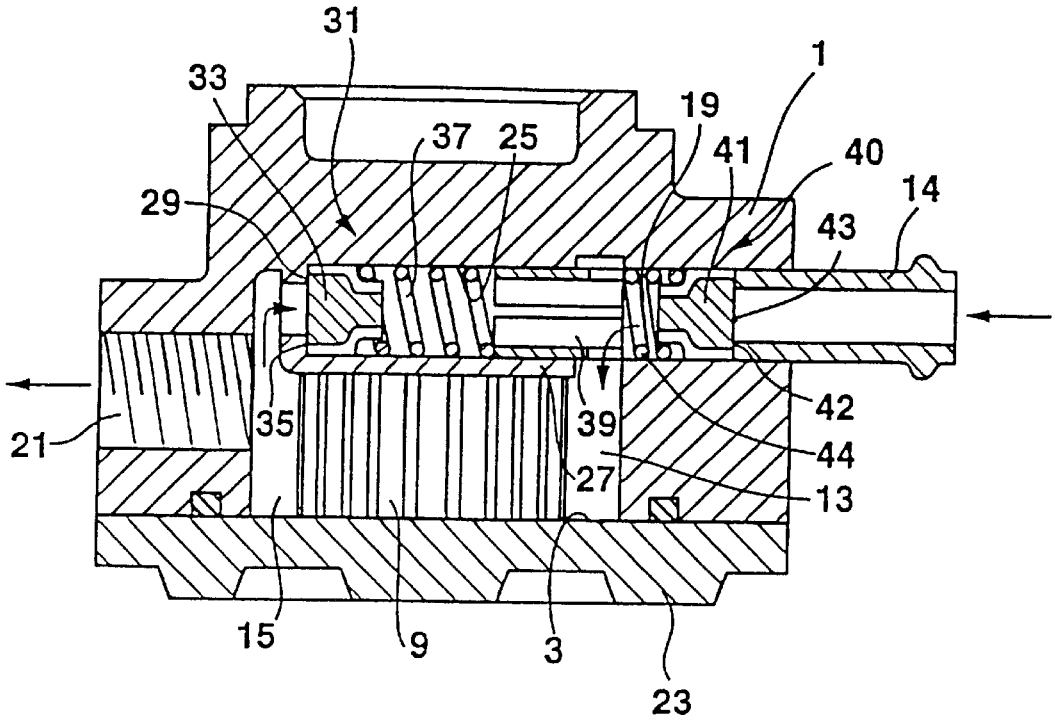
FIG. 3 is a section through FIG. 2 along the line III—III, in which the position of the bypass conduit and the pressure valve disposed in it is represented, as well as the disposition according to the invention of a pressure valve in an opening of the housing.

FIGS. 1 to 3 show different views of a first embodiment of a fuel delivery pump, which is inserted in a supply line, not shown, from a storage tank to a fuel injection pump for internal combustion engines. In its housing 1, the delivery pump has a pump chamber 3 in which a rotary driven pair of gears 7, 9 is disposed that mesh with each other. A first gear 7 fastened to a shaft 5 is driven to rotate by means of an external drive element, not shown in detail, and transmits this rotary motion by means of an end face gearing to a second gear 9 that meshes with the first gear 7 and is disposed on an axle 11 supported in the housing. By means of their tooth engagement, the gears 7, 9 divide the pump chamber 3 into two parts of which a first part constitutes an intake chamber 13 and a second part constitutes a pressure chamber 15. The intake chamber 13 communicates with the pressure chamber 15 via a supply conduit 17 formed between the tooth grooves on the end face of the first gear 7 and the second gear 9, and the circumference of the pump edge 3. In addition, the intake chamber 13 and the pressure chamber 15 each have a connection opening 19, 21 in the wall of the pump housing 1, via which the intake chamber 13 communicates with a connecting element 14 of an intake line, not shown, from the storage tank and via which the pressure chamber 15 communicates with a supply line, not shown, into the intake chamber of the fuel injection pump. The connection opening into the intake chamber 13 constitutes an inlet opening 19 and the connection opening into the pressure chamber 15 constitutes an outlet opening 21. The pump chamber 3 is sealed on its one end face in the axial direction of the shaft 5 and the axle 11 by a housing cover 23, which has been removed in the depiction in FIG. 2 and thus permits a view of the pump interior.

Furthermore, a bypass conduit 25 is provided in the pump housing 1 for a pressure control of the delivery pressure in the pressure chamber 15. This bypass conduit 25 is constituted by means of a bore in an intermediary housing piece 27 which defines the pump chamber 3 on its end face remote from the housing cover 23, divides the pressure from the suction side, and thus constitutes a pump chamber wall. The bore that constitutes the bypass conduit 25 is disposed so that its cross section projected in the axial direction is disposed completely inside the internal cross section of the inlet opening 19. The bore that constitutes the bypass conduit 25 is embodied as a through bore whose one end feeds into the pressure chamber 15 and whose other end feeds into the intake chamber 13. On the pressure side, the bypass conduit 25 has a cross sectional reduction in the direction of the pressure chamber 15, which reduction is formed by a bore shoulder, wherein the annular shoulder formed on the bypass conduit end constitutes a valve seat 29 of a pressure valve 31 disposed in the bypass conduit 25. A valve closing member 33 of the pressure valve 31 comes into contact with this valve seat 29 by means of a sealing face 35 formed on its pressure chamber end face due to the force of a valve spring 37. This valve spring 37 in the bypass conduit 25 engages the valve closing member 33 via a shoulder and is supported on the other end against a clamping collar 39 inserted into the intake chamber end of the bypass conduit 25. Analogous to the other components of the pressure valve 31, this clamping collar 39 can be inserted into the bypass conduit 25 via the inlet opening 19, wherein via the axial installation depth of the clamping collar 39, which unblocks a through flow cross section, the initial force of the valve spring 37 and consequently the opening pressure of the pressure valve 31 in the bypass conduit 25, the pressure chamber 15, and the intake chamber 13 can be adjusted. The clamping collar 39 can be press fitted into the bypass conduit 25 or can be screwed in by means of a thread so that a very precise axial position fixing of the clamping collar 39 is possible.

An element 14, which is embodied as a hose fitting, is inserted into the inlet opening 19. This hose fitting 14 can be press fitted to the housing 1 by means of a quick acting closure or can be screwed in by means of a thread, or can be fastened to the housing 1 by means of a quick acting connection. A valve closing member 41 is guided in the inlet opening 19, which closes the intake chamber 13 in relation to a supply line, not shown, from a storage tank to the fuel delivery pump. The valve closing member 41 has a diameter that corresponds to the opening cross section of the inlet opening 19 and can move axially in the inlet opening 19 in opposition to a valve spring 44. The end of the hose fitting 14 pointing toward the intake chamber 13 constitutes a cross sectional reduction of the inlet opening 19, which constitutes a valve seat 42 of a check valve 40 inserted into the inlet opening 19. Due to the force of the valve spring 44, this valve seat 42 is contacted by the valve closing member 41 of the check valve 40 with a on its sealing face 43 pointing toward the hose fitting 14. This valve spring 44 in the inlet opening 19 engages the valve closing member 41 via a shoulder and is supported on the other end against the clamping collar 39 inserted into the intake chamber end of the bypass conduit 25. This clamping collar 39 penetrates the intake chamber 13 and adjoins the inlet opening 19.

The inlet opening 19 has a cross section that corresponds to the outer diameter of the clamping collar 39 so that the valve spring 44 can be supported against the end face of the clamping collar 39. The initial force of the valve spring 44 can be adjusted by means of the length of the clamping collar 39, which can also extend into the inlet opening 19, as well as by means of the insertion depth of the hose fitting 14 into the inlet opening 19 so that a particular opening force of the pressure valve 40 in the inlet opening 19 can be set. The pressure valves 31 and 40 are advantageously embodied as structurally identical so that a reasonably priced embodiment is possible. Furthermore, the pressure valve 31 and the check valve 40 operate independently of each other.

In the region in which the clamping collar 39 passes through the intake chamber 13, it has opening slots so that the fuel supplied to the fuel delivery pump via a fuel line, not shown, can flow past the check valve 40 and can be supplied to the intake chamber 13 via the opening slots of the clamping collar 39. The fuel returned from the pressure chamber 15 into the bypass conduit 25 can also be returned to the intake chamber 13 via this slot-shaped opening.

Figure 4:
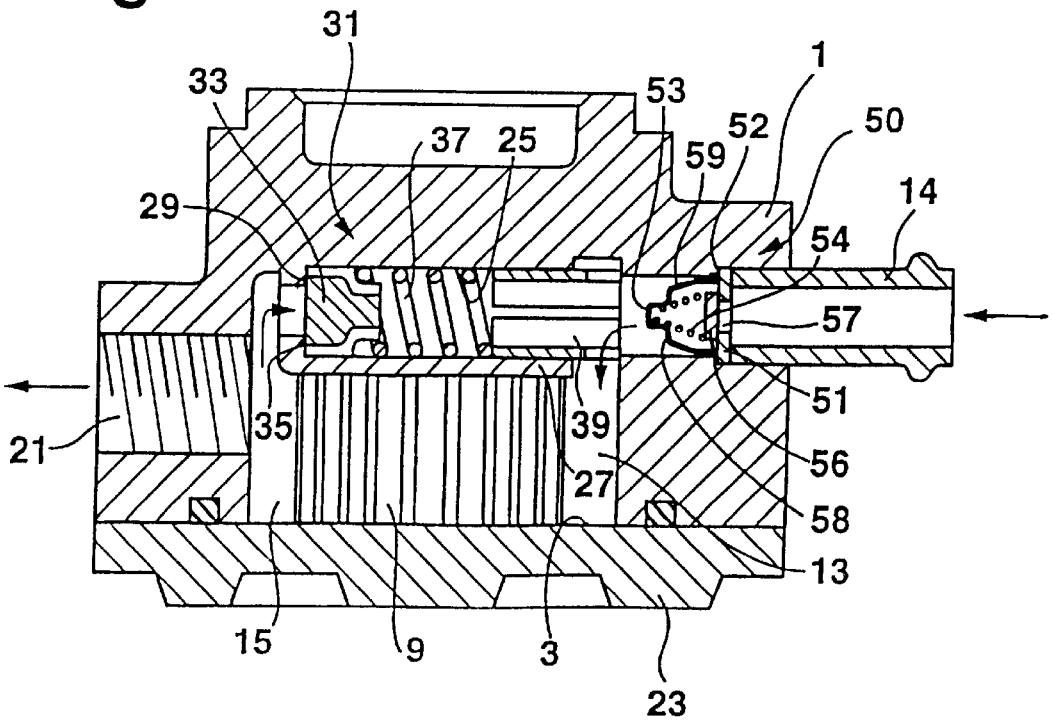
FIG. 4 shows an embodiment of the pressure valve alternative to FIG. 3.

FIG. 4 shows an alternative embodiment of a check valve 50 in relation to the check valve 40 in FIG. 3. The check valve 50 according to FIG. 4 is embodied as a standard component and has an annular cross section 51, which adjoins a shoulder 52 of the inlet opening 19. For axially fixing the check valve 50, a connecting element 14 is screwed or press fitted into the inlet opening 19. A fuel line, not shown, can be connected to this connecting element 19. The annular cross section 51 adjoins a housing 53 that is embodied as cup-shaped, in which a valve spring 54 is supported, which brings a valve closing member 56 into contact with the annular cross section 51. The annular cross section 51 is embodied as a valve seat. The valve closing member 56 can be deflected by the fuel in opposition to the valve spring 54. This fuel flows into the housing 53 through an opening 57 of the annular cross section 51 and flows into the intake chamber 13 via at least one opening 59 disposed in a circumference wall 58 of the housing 53. Analogous to the recesses disposed in the circumference wall in the valve closing member 41, the openings 59 function as throttles which can reduce the delivery flow of fuel with increasing speed of the fuel delivery pump.

In this embodiment, the clamping collar 39 is embodied as shortened in relation to the embodiment in FIG. 3 so that it can be fully inserted into the bypass conduit 25.

Alternatively, the check valve 50 can also be integrated into a connecting element 14 so that there can be a simple installation of the connecting element 14 with a check valve 50 integrated in it. The valve closing member 56 can furthermore be embodied as a ball or the like.

The pressure valve 31 and the check valves 40, 50 can be made out of fuel resistant and temperature resistant plastics or of metallic materials, or of a combination of them.

Figure 5:
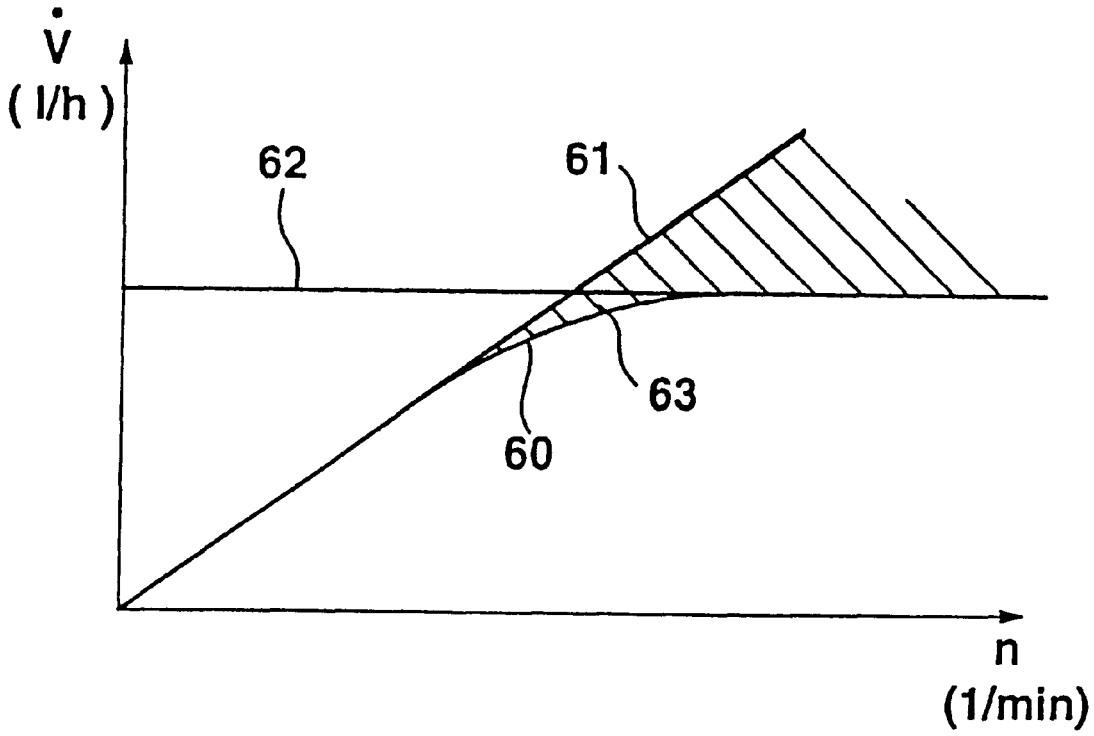
FIG. 5 is a characteristic curve diagram for the exemplary embodiment according to FIGS. 3 and 4.

The fuel delivery pump according to the invention functions in the following manner: During operation of the internal combustion engine, the fuel injection pump and the fuel delivery pump are driven in proportion to the speed of the engine. This is carried out with the delivery pump shown in FIGS. 1 to 4 by means of a mechanical transfer element, not shown, which engages the shaft 5 from the outside. Through the rotation of the first gear 7 and the second gear 9 that meshes with it, fuel is supplied from the intake chamber 13, along the supply conduit 17, and into the pressure chamber 15. In the course of this, a vacuum is produced in the intake chamber 13, which is sufficient to open the check valve 40, 50 and to aspirate fuel from the storage tank via the intake line. The fuel pressure built up in the pressure chamber 15 produces a fuel delivery from it via a supply line into the intake chamber of the fuel injection pump to be supplied. The check valve 40, 50 functions as a throttle which has a gentle transition of the characteristic curve 60 in relation to a theoretical course of the characteristic curve 61 according to FIG. 5, which would also correspond to a characteristic curve if there were no check valve 40, 50. The horizontally extending line 62 is determined by means of the maximal delivery flow of the fuel delivery pump as a function of the opening pressure of the pressure valve 31 in the bypass conduit 25.

The throttle action is based on the fact that in the valve closing member 41, recesses are distributed evenly over the circumference, which after the valve closing member 41 lifts up from the valve seat 42, permit fuel to flow into the intake chamber 13 via these openings. In the embodiment according to FIG. 4, after the valve closing member 56 lifts up from the valve seat 51, the fuel flows via openings 59 in the housing 53 into the intake chamber.

Parallel to this, the control of the maximal fuel pressure in the pressure chamber 15 and consequently the delivery quantity to the fuel injection pump is carried out via the bypass conduit 25, by virtue of the fact that the valve closing member 33 of the pressure valve 31 inserted in it lifts up from the valve seat 29 starting at a particular pressure in the pressure chamber 15 and thus opens a draining cross section at the bypass conduit 25, via which a portion of the highly pressurized fuel quantity flows out of the pressure chamber 15 into the intake chamber 13. As a result, the delivery quantity flowing from the fuel line, not shown, via the connecting element 14 is reduced.

As a result of the check valve 40, 50 being disposed in the closed position when the fuel delivery pump is shut off, fuel remains in both the intake chamber 13 and the pressure chamber 15 so that when the fuel delivery pump starts up, an immediate supply of fuel to the fuel injection pump is permitted without an additional ventilation being required. As a result, the required operating pressure can be built up within an extremely short time. For example, at starting speed, a pressure of 0.3 bar can be built up within 0.3 seconds, by means of which the engine can be immediately started. At the same time, therefore, a high efficiency of the fuel delivery pump can be achieved with a low operating power, wherein on top of this, the throttle action of the check valves 40, 50 produces a gentle transition of the at first steadily increasing characteristic curve into a gentle transition to the maximal delivery flow so that the delivery pump must produce a reduced operating power, which is represented by the shaded area 63. By adapting the delivery quantity to the required quantity through throttle action, the difference between the quantity delivered and the quantity required is reduced.

The foregoing relates to preferred exemplary embodiments of the invention, it being understood that other variants and embodiments thereof are possible within the spirit and scope of the invention, the latter being defined by the appended claims.

We claim:

1. A fuel delivery pump for a fuel injection pump for internal combustion engines, comprising a pair of rotating displacing elements (7, 9) that mesh with each other and are driven to rotate in a pump chamber (3) of a housing (1), said rotating displacing elements, deliver fuel from an intake chamber (13) connected to a storage tank, along a supply conduit (17) that is formed between an end face of the rotating displacing elements (7, 9) and a circumference wall of the pump chamber (3), into a pressure chamber (15) connected to the fuel injection pump, and with a bypass conduit (25), which is disposed in said housing (1) of the fuel delivery pump and connects the intake chamber (13) to the pressure chamber (15), and said bypass conduit is opened by means of a pressure valve (31) disposed in said bypass conduit, and the intake chamber (13) is closed with a check valve (40, 50) that is inserted in an opening (19) of the housing (1) that leads to the intake chamber (13) which operates in opposition to the fuel delivery direction, and by inflow opening 19 of the housing 1 discharges into the intake chamber 13, and said inflow opening is closable by a valve closing member 41 of a check valve 40 under an influence of a closing spring 44.

2. A fuel delivery pump according to claim 1, in which the check valve (40, 50) is a throttling valve.

3. A fuel delivery pump according to claim 2, in which the check valve (40) is disposed in the opening (19) and is opened in the fuel direction in opposition to a valve spring (44) disposed in the opening (19).

4. A fuel delivery pump according to claim 2, in which the check valve (50) is inserted into the opening (19) and is disposed downstream of a connecting element (14).

5. A fuel delivery pump according to claim 1, in which the check valve (40) is axially disposed in the opening (19) and is opened in the fuel direction in opposition to a valve spring (44) disposed in the opening (19).

6. A fuel delivery pump according to claim 5, in which a valve seat (42) and the cross section reducing connecting element (14) is inserted into the opening (19) and A sealing face (43) of the valve closing member (41) of the check valve (40) is in a sealing contact with said valve seat by the influence of the valve spring (44).

7. A fuel delivery pump according to claim 6, in which the valve spring (44) is supported against a clamping collar (39) that is inserted into the intake chamber end of the bypass conduit (25), and is disposed opposite the valve closing member (41).

8. A fuel delivery pump according to claim 6, in which the connecting element (14) is embodied as a hose fitting which is inserted into the opening (19) of the housing (1) and is closed with a quick acting closure.

9. A fuel delivery pump according to claim 5, in which the valve spring (44) is supported against a clamping collar (39) that is inserted into the intake chamber end of the bypass conduit (25), and is disposed opposite the valve closing member (41).

10. A fuel delivery pump according to claim 9, in which the clamping collar (39) adjoins the opening (19) or at least partially engages in the opening (19) and is embodied as slotted in a region that passes through the intake chamber (13).

11. A fuel delivery pump according to claim 1, in which the check valve (50) is inserted into the opening (19) and is disposed downstream of a connecting element (14).

12. A fuel delivery pump according to claim 11, in which the check valve (50) includes a valve closing member and a valve 1closing disposed in a housing (53) which forces said valve closing member (56) into contact with an annular cross section (51) which a valve seat.

13. A fuel delivery pump according to claim 12, in which at least one opening (59) is provided in a circumference wall (58) of the housing (53).

14. A fuel delivery pump according to claim 12, in which the check calve (50) is integrated into the connecting element (14).

15. A fuel delivery pump according to claim 11, in which at least one opening (59) is provided in a circumference wall (58) of the housing (53).

16. A fuel delivery pump according to claim 15, in which the check valve (50) is integrated into the connecting element (14).

17. A fuel delivery pump according to claim 11, in which the check valve (50) is integrated into the connecting element (14).

* * * * *